US006581667B2

(12) United States Patent
Waring

(10) Patent No.: US 6,581,667 B2
(45) Date of Patent: Jun. 24, 2003

(54) DEBRIS BARRIER

(75) Inventor: Thomas Waring, Cambridge (CA)

(73) Assignee: Babcock & Wilcox Canada Ltd., Cambridge (CA)

( * ) Notice: Subject to any disclaimer, the term of this patent is extended or adjusted under 35 U.S.C. 154(b) by 0 days.

(21) Appl. No.: 09/928,323

(22) Filed: Aug. 13, 2001

(65) Prior Publication Data

US 2003/0029583 A1 Feb. 13, 2003

(51) Int. Cl.[7] ..... A47G 5/00
(52) U.S. Cl. ..... 160/351; 160/372; 160/377
(58) Field of Search ..... 160/371, 372, 160/377, 351; 38/102.1, 102.4, 102.8, 102.9; 451/455, 457; 228/59

(56) References Cited

U.S. PATENT DOCUMENTS

| | | | | |
|---|---|---|---|---|
| 4,085,789 A | | 4/1978 | Steiner et al. |
| 4,208,458 A | | 6/1980 | Wilson |
| 4,842,035 A | | 6/1989 | Thompson |
| 4,944,444 A | | 7/1990 | Renner |
| 5,024,262 A | * | 6/1991 | Huang |
| 6,206,079 B1 | | 3/2001 | Selgrad |

FOREIGN PATENT DOCUMENTS

| | | |
|---|---|---|
| CA | 492356 | * 4/1953 |
| FR | 1167367 | * 11/1958 |
| IT | 456942 | * 12/1950 |

* cited by examiner

*Primary Examiner*—Blair M. Johnson
(74) *Attorney, Agent, or Firm*—Kathryn W. Grant; Eric Marich

(57) ABSTRACT

A removable debris shield and method to internally protect a portion of a vessel, such as a pressure vessel, during fabrication. Pliant material sufficient to span a desired interior portion of the vessel has a hem located around the periphery of the material and having at least one opening. A hoop is removably inserted through the opening into the hem to extend the material across the desired interior portion of the vessel. In one embodiment, a spreader bolt spreads the hoop to force it tightly against the walls of the vessel.

4 Claims, 2 Drawing Sheets

DEBRIS BARRIER

FIELD AND BACKGROUND OF INVENTION

There are many designs of barriers to control debris when working inside a large vessel such as a pressure vessel. Various types of barriers have been used to seal off the vessel in order to prevent debris and insulation from being introduced into undesirable areas during fabrication or repair.

If a debris barrier is installed inside a completed vessel, it is normally made of many small parts in order to fit through conventional access openings. This is time-consuming, since parts must be assembled within the vessel and then disassembled for removal, and may release additional debris.

In one approach, a metal diaphragm or disk is assembled from many small parts, like a jig saw puzzle, which are held together with nuts and bolts. The parts must be small so they can be inserted and removed through access manways that are typically only 16" to 24" wide. These many small parts can become loose and serve as another source of debris. The metal disk is heavy, and can easily damage sensitive components nearby. Another disadvantage is that, after exposure to stress relief temperatures of up to 1220 deg F., the structure becomes very difficult to disassemble. The bolts must usually be removed with a cutting torch, thus serving as yet another potential source of debris.

In a second approach, insulation has been stuffed into a cavity as a barrier against debris. Removing the insulation is messy and difficult. Grinding dust and other debris that become trapped in the folds and cavities of the insulation are easily released back into the vessel during removal. The insulation is also friable and can serve as source of debris as it is removed.

From the preceding discussion it is apparent that a lightweight, temperature-resistant debris barrier or shield that has few or no small parts, and can be assembled in a confined space without tools after passing through a tight passage, such as a pressure vessel manway, would be welcomed by industry.

SUMMARY OF THE INVENTION

The present invention is generally drawn to a temporary, multi-function sealing debris barrier which can be configured either as a heat resistant shield or a non-heat resistant grinding shield, and more particularly to a removable debris shield to internally protect a portion of a vessel, such as a pressure vessel, during fabrication.

Accordingly, it is an object of the invention to provide a removable debris shield, suitable for use in a cylindrical vessel.

It is a further object of the invention to provide a removable debris shield, suitable for use in a closed vessel, which is lightweight.

Another object of the invention is to provide a removable debris shield, suitable for use in a closed vessel, which has few or no small parts.

Yet another object of the invention is to provide a removable debris shield, suitable for use within a confined space, which is easy to install and remove through conventional access openings and without the use of any tools.

Accordingly one aspect of the invention is drawn to a removable shield for use within a vessel, comprising: pliant material sufficient to span a desired interior portion of the vessel, a hem located around the periphery of the material and having at least one opening, and a hoop, having a first end and a second end, removably inserted through the at least one opening into the hem to extend the material across the desired interior portion of the vessel.

Another aspect of the invention is to provide a removable shield for use within a cylindrical pressure vessel having an inside diameter, comprising: pliant material having a span larger than the inside diameter of the vessel, a generally circular hem located around the periphery of the material and having at least one opening, a generally circular hoop with a diameter larger than the inside diameter of the vessel and having a first end and a second end, the hoop being removably inserted through at least one opening into the hem to extend the material across the inside diameter of the pressure vessel, and spreader bolt having a nut, and a threaded section and an unthreaded section with a shoulder therebetween, wherein the spreader bolt is removably inserted into the first and second ends of the hoop and the first and second ends of the hoop are spread apart from each other by adjusting the nut.

Yet another aspect of the invention is a method of shielding an interior portion of a vessel having an access opening from debris, comprising: providing pliant material sufficient to span a desired interior portion of the vessel, the material having a hem located around the periphery and the hem having at least one opening, providing a hoop having a first end and a second end, inserting the material and the hoop through the access opening into the vessel, and inserting the hoop through at least one opening of the hem to extend the material across the diameter of the vessel.

The various features of novelty which characterize the invention are pointed out with particularity in the claims annexed to and forming part of this disclosure. For a better understanding of the present invention, and the operating advantages attained by its use, reference is made to the accompanying drawings and descriptive matter, forming a part of this disclosure, in which a preferred embodiment of the invention is illustrated.

BRIEF DESCRIPTION OF THE DRAWINGS

In the accompanying drawings, forming a part of this specification, and in which reference numerals shown in the drawings designate like or functionally similar parts throughout the same.

DESCRIPTION OF THE PREFERRED EMBODIMENTS

Figure 1:
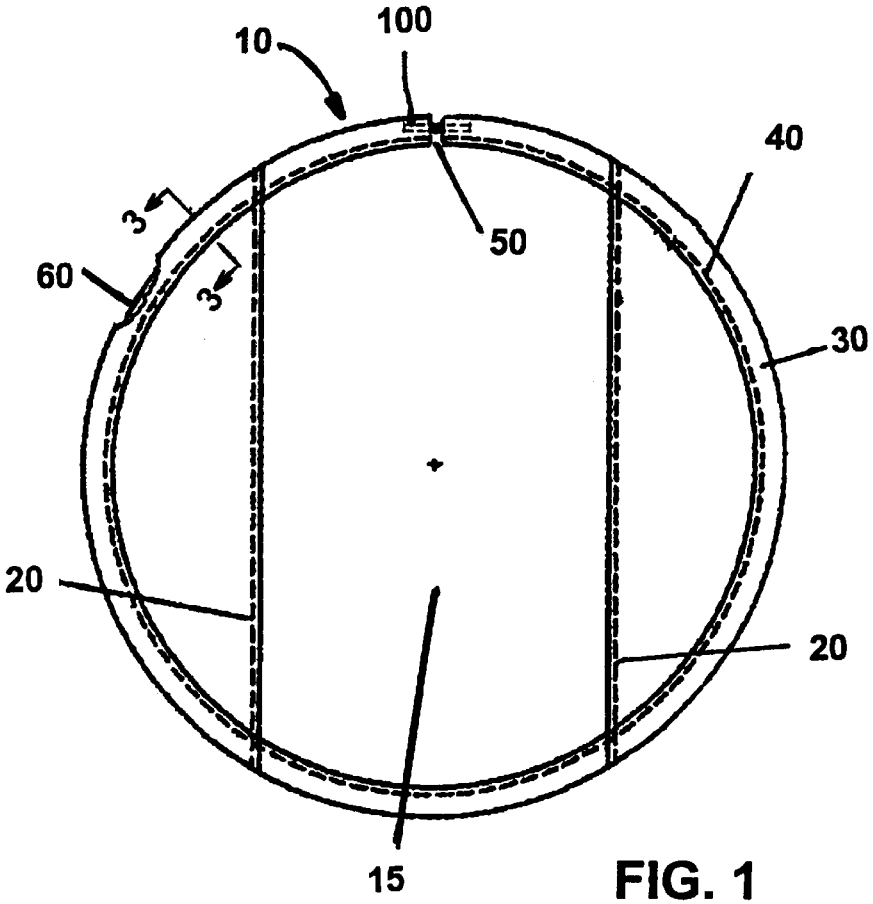
FIG. 1 is a plan view of the invention showing the debris barrier after assembly.

Referring to FIG. 1, a debris barrier generally designated 10 is constructed as follows. A generally circular disk 15 is cut from a length of fabric or other pliant material. For a cylindrical vessel, the diameter of the disk 15 is preferably selected so that the resulting disk 15 is slightly larger than the inside diameter of the vessel to be sealed. As shown in FIG. 1, if the material is not wide enough to span the desired interior portion of the vessel, sufficient material can be heat sealed, glued with adhesives, sewn, or otherwise joined together via seams 20 to provide a disk having the required width. A hem 30 is formed around the periphery of disk 15 at 40, leaving at least one opening 50, for example at the 12 o'clock position. The hem may be formed by doubling back the border of the material and fixing it in place via heat sealing, adhesives, sewing or the like. The hem is preferably about three to four inches wide.

Figure 3:
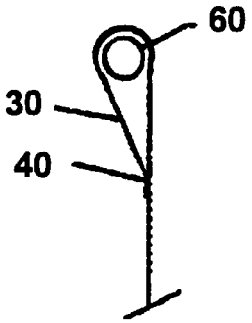
FIG. 3 is an enlarged cross-sectional view of a portion of the debris barrier illustrated in FIG. 1 viewed in the direction of arrows 3-3.

A large hoop 60, having a first and second end, is rolled to a diameter several feet larger than the diameter of the vessel. One end of the hoop 60 and disk 15 are placed within a vessel 70 through conventional access openings, such as manway 80 shown in FIG. 2. The hoop 60 is then inserted into the hem 30 via the opening 50, and pushed through the hem 30 until the hoop 60 is inserted fully through the hem 30, as shown in FIG. 3. While hoop 60 is shown as tubular in cross-section, the subject invention is not limited to a particular cross-section, and could be made, for example, from a rod or merely of a piece of flat steel.

Figure 2:
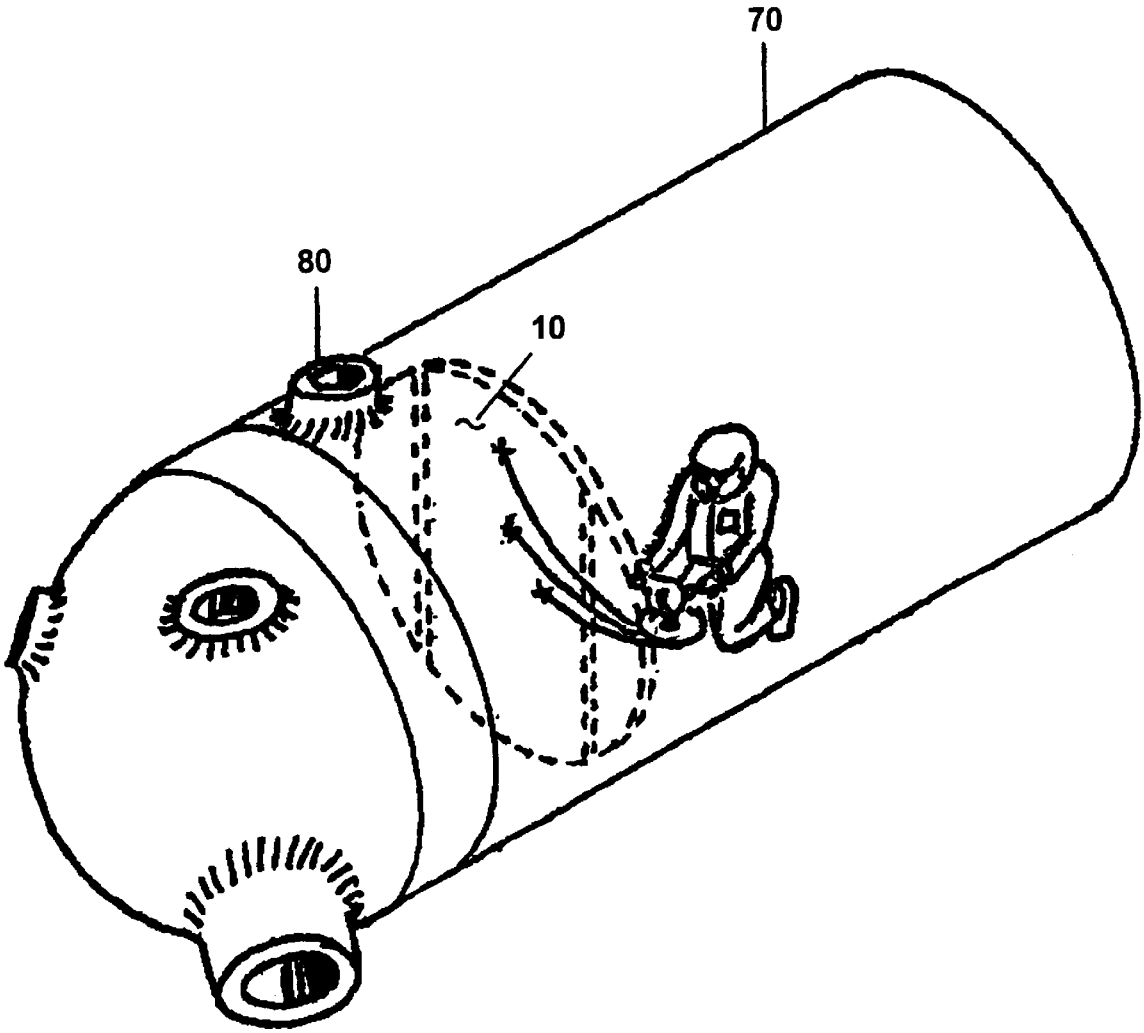
FIG. 2 is a perspective view of the invention in use as a debris shield during a grinding operation within a pressure vessel.

Inside the vessel, the hoop exerts an outward force when sprung into the vessel, and the spring action of the open hoop extends the fabric of the debris barrier and holds the debris barrier in place inside the pressure vessel, as shown in FIG. 2.

The debris barrier is very versatile. A debris barrier of a given diameter can accommodate a wide variation in vessel diameter. The fabric can be selected to accommodate various temperature conditions. For example, for applications where heat resistance is important, a high temperature textile fabric, such as Nextel™ aerospace fabric, available from 3M Company, or preferably Siltemp® silica textile, available from AMETEK, Inc. can be used. The fabric can then be stitched together with a high temperature thread, such as Kevlar® thread, available from Dupont Co., and the hoop would typically be made of heat-resistant tubing, such as rolled Inconel® tubing available from Special Metals Corporation. Where heat resistance is not important, for example for use as a grinding shield, the fabric of the debris barrier could be made of canvas.

The following example is illustrative of the present invention:

EXAMPLE

The subject invention was tested on a full size mock up of a horizontal, cylindrical pressure vessel. The vessel 70 had an inside diameter of approximately eleven feet (11') with a single manway 80 approximately sixteen inches (16") in diameter located at the top of the vessel.

A tubular hoop 60 was passed in through the manway 80 in a fashion similar to threading a key onto a key ring. A fabric disk 15 was draped down through the manway 80 into the vessel. During installation, a first installer held the opening 50 of the hem 30 of the disk 15 outside the vessel to prevent the fabric disc from dropping inside the vessel 70.

From inside the vessel 70, a second installer introduced an end of the hoop 60 into the opening 50 in hem 30, and fed it around inside the hem 30 until it re-emerged from the opening 50 in the hem 30. The second installer, still within the vessel 70, temporarily supported the weight of the assembly while the first installer, still outside of vessel 70, reached in through manway 80 to install an optional spreader bolt 100, shown in FIG. 1 and FIG. 4, between each of the open ends of the tubular hoop 60. Optional spreader bolt 100 was used to help ensure a better seal. The spreader bolt was adjusted to spread the hoop 60 to force it tightly against the walls of the vessel 70 effectively sealing off a portion of vessel 70.

Figure 4:
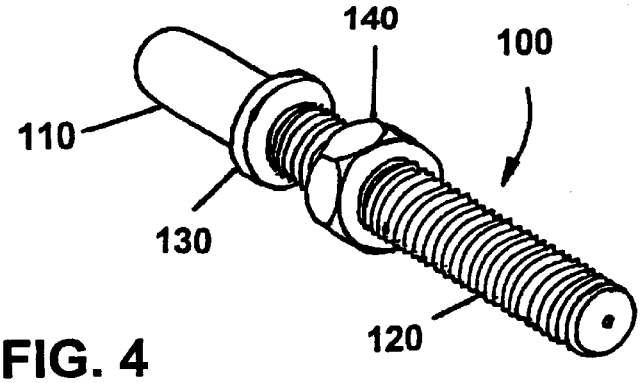
FIG. 4 is an enlarged perspective view of a spreader bolt used in one embodiment of the subject invention.

The spreader bolt 100 used in this example was a custom-made, one-piece bolt, preferably made of stainless steel, with an approximate overall length of six inches. As shown in FIG. 4, the spreader bolt 100 has an unthreaded section 110 at one end that is sized to fit into the end of hoop 60. The other end of spreader bolt 100 has a threaded section 120 that is similarly sized to fit into the end of hoop 60, but is fully threaded up to shoulder 130. Shoulder 130 is located approximately 2" in from the end of the unthreaded section 110, and separates the unthreaded section 110 from the threaded section 120. A free running nut 140, also preferably of stainless steel, is initially installed up to the shoulder 130. The ends of the hoop 60 are adapted to receive the spreader bolt when it is used, and the diameters of both the shoulder 130 and the nut 140 are large enough so that they cannot be inserted inside the ends of the hoop 60.

To install the spreader bolt 100, the longer threaded section 120 is inserted into the end of the hoop 60. The ends of the hoop 60 are manually spread sufficiently to allow the short unthreaded section 110 of the spreader bolt to be inserted into the other end of the hoop 60. The free running nut 140 is then adjusted until the hoop 60 exerts sufficient force to form a seal. Spreader bolt 100 thus allows the debris barrier to be adjusted so that it contacts the inside diameter of vessel 70, firmly and removably holding the debris barrier in place.

While specific embodiments and/or details of the invention have been shown and described above to illustrate the application of the principles of the invention, it is understood that this invention may be embodied as more fully described in the claims, or as otherwise known by those skilled in the art (including any and all equivalents), without departing from such principles. For example, the example above demonstrates the subject invention in use within a horizontal cylindrical vessel of a specific size. The invention, however, could also be applied to a vertical cylindrical vessel and, with some changes to the dimensions, to vessels of various sizes. Also the hoop need not be circular in cross-section.

I claim:

1. A method of shielding an interior portion of a vessel having an access opening from debris, comprising:

a. providing pliant material sufficient to span a desired interior portion of the vessel, the material having a hem located around the periphery and the hem having at least one opening;

b. providing a hoop having a first end and a second end;

c. inserting the material and the hoop through the access opening into the vessel; and d. inserting the hoop through the at least one opening of the hem to extend the material across the diameter of the vessel.

2. The method of claim 1, wherein the hem and hoop are generally circular.

3. The method of claim 1, comprising inserting spreading means into the first and second ends of the hoop to spread apart the first and second ends of the hoop.

4. The method of claim 1, comprising removing the hoop from the material; and then removing the material and the hoop from the vessel through the access opening.

* * * * *